US010130154B2

(12) United States Patent
Irie

(10) Patent No.: US 10,130,154 B2
(45) Date of Patent: Nov. 20, 2018

(54) DRAWING APPARATUS AND DRAWING METHOD FOR DRAWING APPARATUS

(71) Applicant: CASIO COMPUTER CO., LTD., Shibuya-ku, Tokyo (JP)

(72) Inventor: Tamotsu Irie, Higashiyamato (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/466,564

(22) Filed: Mar. 22, 2017

(65) Prior Publication Data

US 2017/0273432 A1 Sep. 28, 2017

(30) Foreign Application Priority Data

Mar. 25, 2016 (JP) ..... 2016-061115

(51) Int. Cl.

| | |
|---|---|
| ***G06F 3/12*** | (2006.01) |
| ***A45D 29/00*** | (2006.01) |
| ***A45D 34/04*** | (2006.01) |
| ***B41J 3/407*** | (2006.01) |

(52) U.S. Cl.

CPC ..... *A45D 29/00* (2013.01); *A45D 34/04* (2013.01); *B41J 3/407* (2013.01); *B41J 3/4073* (2013.01)

(58) Field of Classification Search

None

See application file for complete search history.

(56) References Cited

U.S. PATENT DOCUMENTS

| | | | | |
|---|---|---|---|---|
| 4,621,428 | A * | 11/1986 | Fukumura | G01D 15/00 15/236.01 |
| 5,240,334 | A * | 8/1993 | Epstein | B41J 2/16508 33/1 M |
| 5,589,865 | A * | 12/1996 | Beeson | B41J 2/16535 347/28 |
| 6,286,511 | B1 | 9/2001 | Weber et al. | |
| 6,286,517 | B1 * | 9/2001 | Weber | A45D 29/00 132/200 |
| 6,347,859 | B1 * | 2/2002 | Kawakami | B41J 2/1433 347/20 |
| 6,378,981 | B1 * | 4/2002 | Wenzel | B41J 2/16552 347/28 |
| 9,205,672 | B1 * | 12/2015 | Bitoh | B41J 3/407 |
| 9,526,313 | B2 | 12/2016 | Asako | |
| 2002/0149640 | A1 * | 10/2002 | Gomez | B41J 29/393 347/19 |

(Continued)

FOREIGN PATENT DOCUMENTS

| | | |
|---|---|---|
| JP | 60022396 U | 2/1985 |
| JP | 02023433 Y2 | 6/1990 |

(Continued)

*Primary Examiner* — Ted Barnes

(74) *Attorney, Agent, or Firm* — Holtz, Holtz & Volek PC

(57) ABSTRACT

A drawing apparatus includes a drawing device provided with at least one pen or nozzle configured to perform a drawing on a nail, a processor which controls operations of the pen or the nozzle, and a cleaning pad provided to clean a tip of the pen or the nozzle. The processor causes the tip of the pen or the nozzle to be cleaned by bringing the tip of the pen or the nozzle into a pressed state where the tip of the pen or the nozzle is pressed against the cleaning pad.

15 Claims, 6 Drawing Sheets

(56) References Cited

U.S. PATENT DOCUMENTS

2002/0149641 A1* 10/2002 Du ..... B41J 2/16579 347/23
2007/0068560 A1* 3/2007 Shang ..... B41J 2/16526 134/34
2008/0018677 A1* 1/2008 White ..... B41J 2/16526 347/5
2013/0012648 A1* 1/2013 Fujie ..... C09B 69/101 524/547
2013/0019799 A1* 1/2013 Bitoh ..... B41J 3/407 118/300
2013/0021395 A1* 1/2013 Bitoh ..... A45D 29/00 347/2
2013/0176359 A1* 7/2013 Roberts ..... B41J 2/16526 347/28
2014/0060560 A1* 3/2014 Bitoh ..... A45D 29/00 132/73
2015/0107998 A1* 4/2015 Fobel ..... G01N 27/44791 204/601
2015/0128981 A1* 5/2015 Asako ..... A45D 29/00 132/200
2015/0375526 A1* 12/2015 Yamasaki ..... B41J 3/4073 347/9
2016/0009093 A1* 1/2016 Andrew ..... B41J 2/16535 15/210.1
2016/0067973 A1* 3/2016 Buck ..... B41J 2/16552 347/28
2017/0057232 A1* 3/2017 De Roeck ..... B41J 2/165

FOREIGN PATENT DOCUMENTS

JP 07164792 A 6/1995
JP 07276893 A 10/1995
JP 2003534083 A 11/2003
JP 2015092958 A 5/2015
JP 2015177855 A 10/2015

* cited by examiner

DRAWING APPARATUS AND DRAWING METHOD FOR DRAWING APPARATUS

CROSS-REFERENCE TO RELATED APPLICATIONS

This application is based upon and claims the benefit of priority from the prior Japanese Patent Application No. 2016-061115, filed Mar. 25, 2016, the entire contents of which are incorporated herein by reference.

BACKGROUND OF THE INVENTION

1. Field of the Invention

The present invention relates to a drawing apparatus and a drawing method for a drawing apparatus.

Conventionally, drawing apparatuses for drawing nail designs on nails are known (e.g. see Japanese Unexamined Patent Application Publication (Translation of PCT Application) No. 2003-534083).

Additionally, using a plotter drawing apparatus, in which a drawing utensil (a drawing tool, namely a pen) for performing the drawing is mounted, as a drawing apparatus (nail printing apparatus) for drawing a nail design such as a color or a pattern on a surface of a nail is also being investigated.

Compared to an ink jet type drawing apparatus in which small droplets of ink are discharged, there are fewer restrictions related to the viscosity of usable inks, the particle size of the coloring material included in the ink, and the like in cases where drawing is performed by using a pen. With the latter, inks with excellent color development that include coloring material that has a large particle size, and high-viscosity inks such as light-curable inks can be used. With such drawing apparatuses, it is possible to draw various types of nail designs, the same as would be performed at a nail salon.

However, in the case of a drawing apparatus in which a pen is used, if drawing is performed while various types of debris and/or residue of the ink or the like is adhered to the pen tip, the ink will not discharge smoothly. Such debris or residue is a cause of fading, clogging, dripping, and other problems which may lead to incorrect drawing. In this case, the finish quality of the nail printing is negatively affected. Additionally, the pen tip becomes more prone to catching and the like which leads to defects in the traveling of the pen during the drawing. Consequently, there is a possibility of an ink layer already applied to the nail such as a base layer coating, the surface of the nail, the surface of the skin, and the like being damaged.

After drawing, it is difficult to remove debris and residue of ink and the like, which is adhered to the pen tip, once it has dried.

As such, it is preferable that the residue and/or various types of debris adhered to the pen tip be removed at each drawing processing. However, in conventional plotter drawing apparatuses, maintenance on the debris and the like of the pen tip is labor intensive and is typically performed manually after removing the pen from the apparatus.

Here, soaking the pen tip in a cleaning agent (cleaning solution) to clean the pen tip has been considered, but in case of a pen in which the pen tip and the ink storing portion are integrally formed, when the pen tip is immersed in a large volume of a cleaning agent (cleaning solution), the ink component is eluted from the pen tip and the solvent component flows back into the ink storing portion due to the relationship of osmotic pressure and the like. Consequently, there are concerns that the cleaning agent may affect the ink component such as the ink concentration in the ink storing portion may decline.

In light of the problems described above, an object of the present invention is to provide a drawing apparatus and a drawing method for a drawing apparatus whereby, in cases where drawing by using a pen, residue and/or various types of debris can be easily removed from the pen tip after drawing without affecting drawing quality, and stable drawing can be performed.

SUMMARY OF THE INVENTION

The present invention employs the following configuration to solve the problems described above.

A drawing apparatus according to the present disclosure includes:

a drawing device provided with at least one pen or nozzle configured to perform a drawing on a nail;

a processor which controls operations of the pen or the nozzle; and a cleaning pad provided to clean a tip of the pen or the nozzle; wherein the processor causes the tip of the pen or the nozzle to be cleaned by pressing the tip of the pen or the nozzle against the cleaning pad in a pressed state.

A drawing method for a drawing apparatus according to the present disclosure:

wherein the drawing apparatus comprising:

a drawing device provided with at least one pen or nozzle configured to perform a drawing on a nail; and a cleaning pad provided to clean a tip of the pen or nozzle;

the drawing method comprising:

a first cleaning step of causing the tip of the pen or the nozzle to be cleaned by pressing the tip of the pen or the nozzle against the cleaning pad in a pressed state.

A computer-readable recording medium on which a drawing control program for a drawing apparatus is stored according to the present disclosure:

wherein the drawing apparatus comprises a drawing device provided with at least one pen or nozzle configured to perform a drawing on a nail;

a cleaning pad provided to clean a tip of the pen or nozzle; and a computer configured to control operations of the pen or the nozzle; the drawing control program causes the computer to cause the tip of the pen or the nozzle to be cleaned by pressing the tip of the pen or the nozzle against the cleaning pad in a pressed state.

According to the present invention, in cases where drawing is performed by using a pen, residue and/or various types of debris can be easily removed from the pen tip after drawing without affecting drawing quality, and stable drawing can be performed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

Figure 1B:
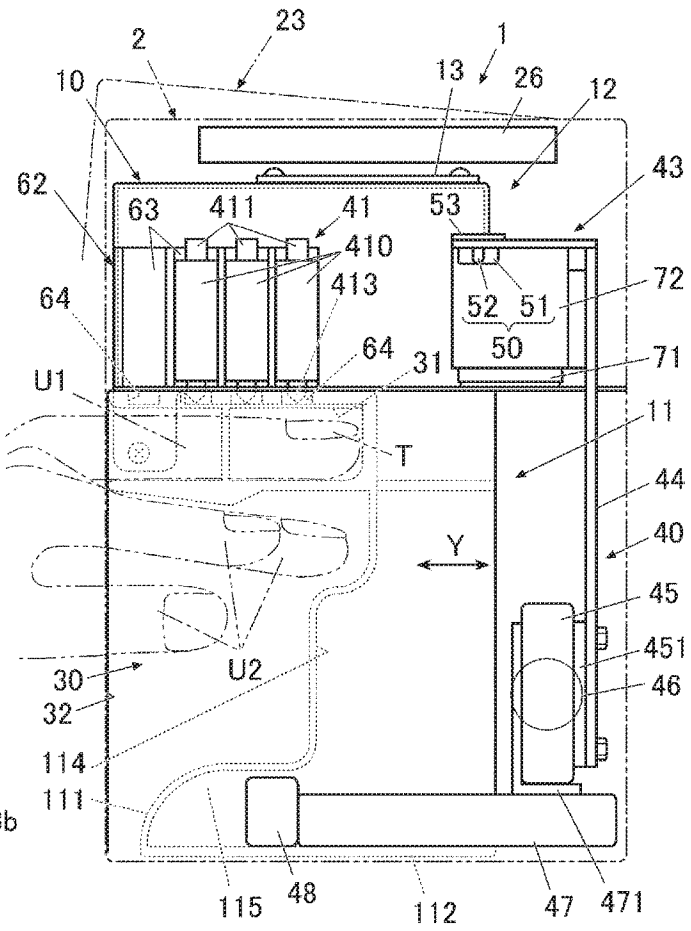
FIG. 1B is a side view illustrating an internal configuration of the drawing apparatus illustrated in FIG. 1A.

An embodiment of the nail printing apparatus (drawing apparatus) and drawing method for the nail printing apparatus (drawing apparatus) according to the present invention are described below while referring to FIGS. 1A to 5.

While various limitations, which are technically preferable from the perspective of carrying out the present invention, are placed on the embodiment described below, the scope of the present invention should not be construed to be limited to the embodiment or the example illustrated in the drawings.

Additionally, in the following embodiment, a nail printing apparatus 1 will be described as an apparatus for drawing on a drawing object, namely a fingernail. However, the drawing object of the present invention is not limited to fingernails, and for example, the drawing object may be a toenail.

Figure 1A:
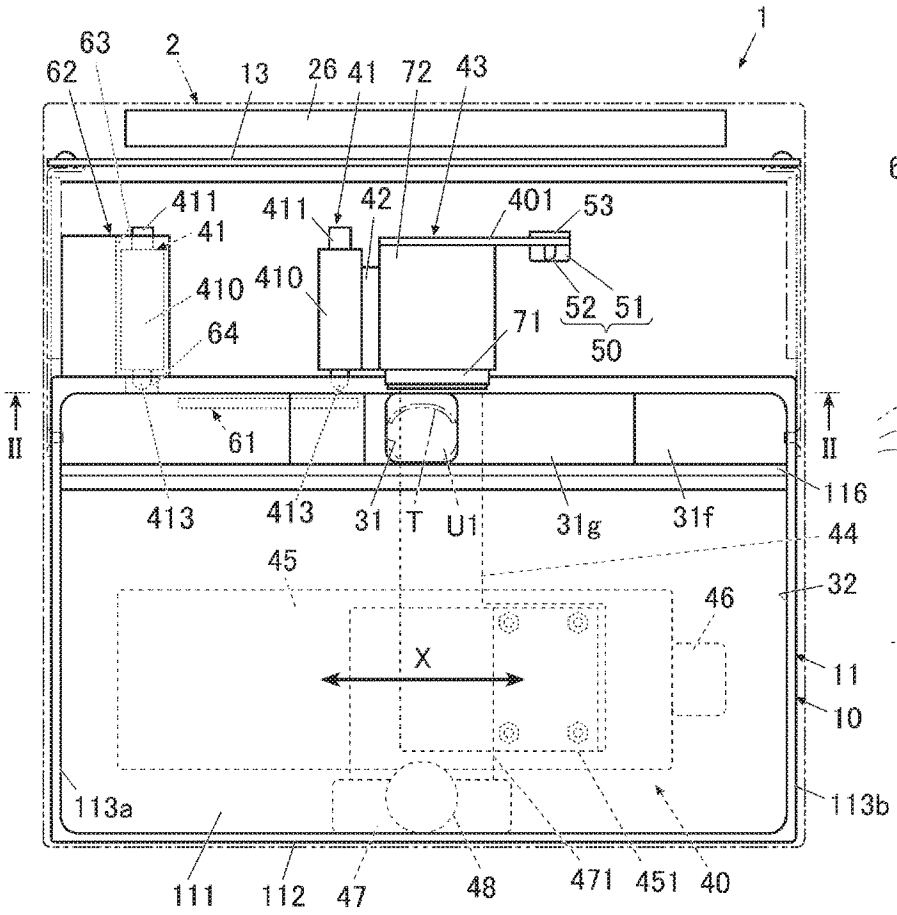
FIG. 1A is a front view of a drawing apparatus according to an embodiment of the present invention.
Figure 2:
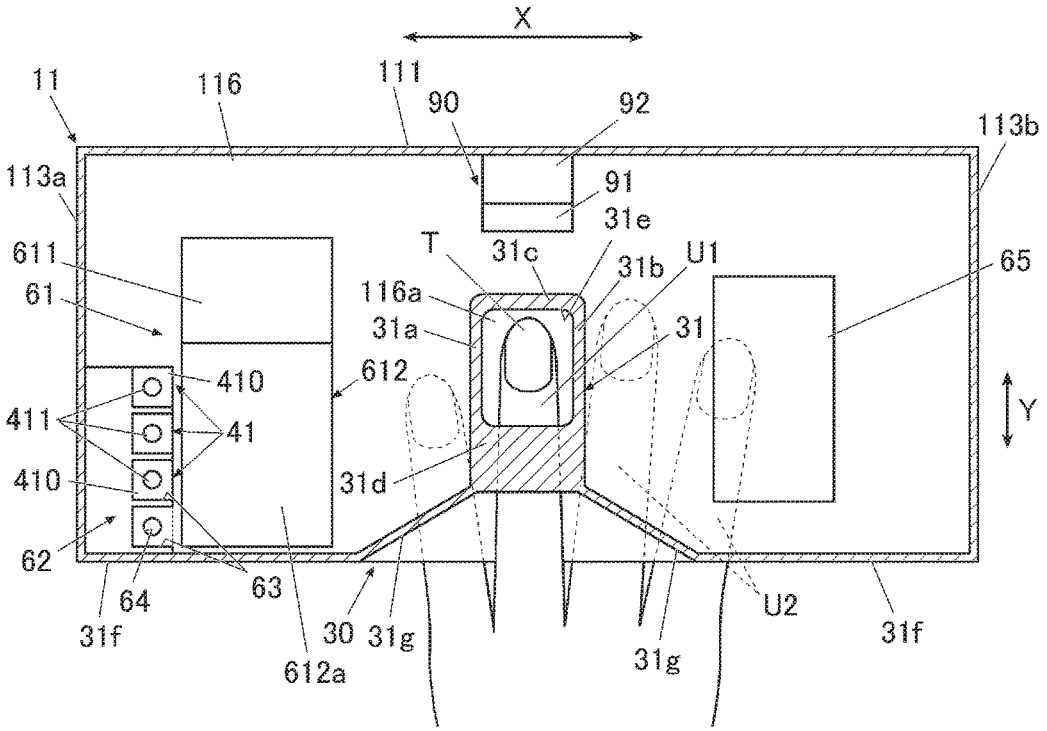
FIG. 2 is a cross-sectional view taken along line II-II of FIG. 1A.

FIG. 1A is a front view illustrating an internal configuration of a nail printing apparatus. FIG. 1B is a side view illustrating the internal configuration of the nail printing apparatus illustrated in FIG. 1A. FIG. 2 is a cross-sectional view taken along line II-II of FIG. 1A.

As illustrated in FIGS. 1A and 1B, in the nail printing apparatus 1 of the present embodiment, a drawing head 43 is provided with drawing tools, namely a pen 41 and an ink jet head 71. The nail printing apparatus 1 of the present embodiment uses plotter printing and ink jet printing to perform a drawing on a nail T.

The nail printing apparatus 1 is provided with a case body 2 and an apparatus main body 10 housed in the case body 2.

As illustrated in FIG. 1B, a cover 23, configured to be openable and closeable, for replacing the pen 41 and the ink jet head 71 of the hereinafter described drawing device 40 is provided on the case body 2 from an upper surface thereof to an upper portion front surface. The cover 23 is rotatable via, for example, a hinge or the like, from a closed state to an open state, as illustrated in FIG. 1B.

An operation unit 25 (see FIG. 3) is set on an upper surface (top panel) of the case body 2.

The operation unit 25 is an input unit where a user performs various types of input.

Operation buttons (not illustrated) for performing various types of input are set in the operation unit 25. Examples of the operation buttons include a power switch button for turning on the power of the nail printing apparatus 1, a stop switch button for stopping operation, a design selection button for selecting a design image to be drawn on the nail T, a drawing start button for commanding the drawing to start, and the like.

A display unit 26 is set approximately in a center portion of the top surface (top panel) of the case body 2.

The display unit 26 is configured from, for example, a liquid crystal display (LCD), an organic electroluminescence display, or other type of flat display.

In the present embodiment, examples of images appropriately displayed on the display unit 26 include nail images obtained by imaging the print finger U1 (finger images including images of the nail T), images of the outline or the like of the nail T included in the nail images, design selection images for selecting a design image to be drawn on the nail T, thumbnail images for design confirmation, command screens displaying various commands, and the like.

Note that a configuration is possible in which a touch panel for performing various types of input is integrated into the surface of the display unit 26.

The apparatus main body 10 is formed into a rough box-shape and is provided with a lower frame 11 set in the lower portion of the interior of the case body 2, and an upper frame 12 set above the lower frame 11 and in the upper portion of the interior of the case body 2.

First, the lower frame 11 will be described.

The lower frame 11 has a back surface plate 111, a bottom plate 112, a pair of left and right side plates 113*a* and 113*b*, an X-direction movement stage housing 114, a Y-direction movement stage housing 115, and a dividing wall 116.

Bottom edges of the side plates 113*a* and 113*b* are joined respectively to left and right edges of the bottom plate 112. The side plates 113*a* and 113*b* are provided in an upright state on the bottom plate 112.

A lower portion of the back surface plate 111 is formed so as to sink forward (toward the finger insertion direction proximal side) in two stages. The bottom edge of the back surface plate 111 is joined to a front edge of the bottom plate 112, and the back surface plate 111 divides the area surrounded by the bottom plate 112 and the side plates 113*a* and 113*b* into front and back.

The space formed on the back side of the sunken back surface plate 111 becomes the X-direction movement stage housing 114 and the Y-direction movement stage housing 115 (see FIG. 1B). An X-direction movement stage 45 of the drawing device 40 is housed in the X-direction movement stage housing 114 when the drawing device 40 is moved forward (toward the finger insertion direction proximal side). A Y-direction movement stage 47 of the drawing device 40 is disposed in the Y-direction movement stage housing 115.

The dividing wall 116 is provided inside the lower frame 11 so as to vertically divide the space on the front side inside the lower frame 11 (the space on the finger insertion direction proximal side surrounded by the back surface plate 111, the bottom plate 112, and the side plates 113*a* and 113*b*). The dividing wall 116 is provided roughly horizontally, left and right edges of the dividing wall 116 are joined respectively to the side plates 113*a* and 113*b*, and a back edge of the dividing wall 116 is joined to the back surface plate 111.

A finger holding portion 30 (see FIG. 1B) is provided integrally in the lower frame 11.

The finger holding portion 30 is configured from a finger receiving portion 31 for receiving the finger corresponding to the nail T (i.e. the drawing object) on which drawing will be performed (hereinafter referred to as "print finger U1"), and a finger clearing portion 32 for clearing fingers other than the print finger U1 (hereinafter referred to as "non-print fingers U2").

The finger receiving portion 31 is disposed on an upper side of the dividing wall 116 and, for example, slightly right of the center in a width direction of the lower frame 11. The space on the lower side of the lower frame 11, partitioned by the dividing wall 116, forms the finger clearing portion 32.

For example, in cases where a drawing is performed on the nail T of a ring finger, the ring finger is inserted into the finger receiving portion 31 as the print finger U1, and the non-print fingers U2, namely the other four fingers (thumb, index finger, middle finger, and little finger) are inserted into the finger clearing portion 32.

As illustrated in FIGS. 1B and 2, the finger receiving portion 31 is open to a front surface side of the lower frame 11 (print finger insertion direction proximal side); and a bottom side is defined by a finger mount portion 116*a* that constitutes a portion of the dividing wall 116, sides are defined by partitions 31*a* and 31*b*, and a rear side is defined by a partition 31*c*. The finger mount portion 116*a* is a constituent where the finger (the print finger U1) of the nail T on which drawing is to be performed is mounted on the X-Y plane.

A top side of the finger receiving portion 31 is defined by a ceiling portion 31*d*. A window 31*e* is formed in the ceiling portion 31*d* for exposing the nail T of the print finger U1 inserted into the finger receiving portion 31.

A front wall 31*f* (see FIG. 1A) that closes the front surface side of the lower frame 11 is provided on the top surface of the dividing wall 116, at both end portions on the front surface side of the lower frame 11. A pair of guide walls 31*g* (see FIG. 1A) that guides the print finger U1 into the finger receiving portion 31 is erected on the top surface of the dividing wall 116, and the pair of guide walls 31*g* narrows from the end of the front wall 31*f* on the center portion side toward the finger receiving portion 31.

A user can pinch the dividing wall 116 between the print finger U1 inserted in the finger receiving portion 31 and the non-print fingers U2 inserted in the finger clearing portion 32. Thus, the print finger U1 inserted in the finger receiving portion 31 is stably held.

A pen standby unit 62 is provided on the top surface of the lower frame 11, beside the finger receiving portion 31 (the left side in FIGS. 1A and 2 in the present embodiment). The pen standby unit 62 is capable of holding the pen 41 at standby within the movable range of the drawing head 43 (described hereinafter).

In the present embodiment, the pen standby unit 62 is provided with four standby holders 63 for holding spare pens 41 at standby. A cap 64 that stores the pen tip 413 of the pen 41 held at standby in the standby holder 63 is provided within each of the standby holders 63. The cap 64 is formed, for example, from rubber, and prevents drying out of the pen tip 413 as a result of the pen tip 413 being stored in the cap 64.

A maintenance part 61 is provided on the top surface of the lower frame 11, near the pen standby unit 62 (at a position nearer to a center portion in the width direction of the apparatus than the pen standby unit 62 in the present embodiment; between the pen standby unit 62 and the finger receiving portion 31 in FIG. 1B) within a drawable area of the drawing head 43. The maintenance part 61 is configured to maintain the pen tip 413 (tip portion) of the pen 41 in a state suitable for performing drawing.

In the present embodiment, the maintenance part 61 is provided with a test drawing part 611 and a cleaning part 612.

As illustrated in FIGS. 4A to 4E, the maintenance part 61 of the present embodiment has a configuration in which the sheet-like test drawing part 611 constituted by a piece of paper or the like constitutes a base serving as a mount of the maintenance part 61, and a sheet-like nonwoven fabric or the like constituting a cleaning pad 612*a* (described hereinafter) is affixed to the surface of a portion (the apparatus proximal side in the present embodiment, as illustrated in FIG. 2) of this base, namely the test drawing part 611.

That is, of the piece of paper or the like serving as the mount, the portion to which the cleaning pad 612*a* is affixed functions as the cleaning part 612, and the portion to which the cleaning pad 612*a* is not affixed (the portion from which the test drawing part 611 constituted by the piece of paper or the like is exposed) functions as the test drawing part 611.

In the present embodiment, the maintenance part 61 is configured such that the mount, namely the piece of paper is removed and replaced with a new piece of paper in a case where there is no empty space remaining in either the test drawing part 611 or the cleaning part 612 as a result of repeated test drawing and cleaning operations of the pen tip 413.

A user may determine the time for replacement of the maintenance part 61. For example, the image capturing device 51 of the imaging unit 50 may capture an image of the maintenance part 61, a control unit (processor) 81 (described hereinafter) may determine the presence or absence of empty space in the test drawing part 611 and the cleaning part 612 from the captured image, and, in cases where no empty space remains, a message or the like prompting the user to replace the maintenance part 61 may be displayed on the display unit 26 or the like and the user may be notified. Additionally, the maintenance part 61 may be configured such that the test drawing part 611 and the cleaning part 612 are divided into the same number of areas, and predetermined regions of the test drawing part 611 and areas of the cleaning part 612 are used for each of the pens 41. As a result of this configuration, the empty space of the test drawing part 611 and the cleaning part 612 will run out at the same time. Thus, both the test drawing part 611 and the cleaning part 612 can be completely used and the mount can be replaced without creating any waste.

Note that specific configurations of the test drawing part 611 and the cleaning part 612 of the maintenance part 61 are not limited to those illustrated in the drawings. For example, a configuration is possible in which another mount is provided separately from the test drawing part 611, and the test drawing part 611 and the cleaning part 612 are disposed above the respective mounts. In this case, when no empty space remains in one of the test drawing part 611 and the cleaning part 612, only the individual mount that has no empty space remaining is removed and replaced.

Additionally, in cases where mounts of the test drawing part 611 and the cleaning part 612 are provided separately, the test drawing part 611 and the cleaning part 612 need not be provided adjacently and may be positioned at any location on the top surface of the lower frame 11.

Of the maintenance part 61, the test drawing part 611 is for performing test drawing of the pen tip 413 to eliminate fading and the like at a time of beginning of drawing.

The test drawing part 611 is a flat drawing media and is, for example, a piece of paper. Note that, provided that test drawing of the pen tip 413 (tip portion) can be performed, the test drawing part 611 is not limited to a piece of paper.

Figure 4A:
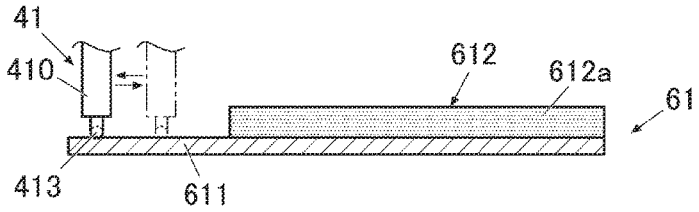
FIG. 4A is an explanatory diagram illustrating an example of test drawing.
Figure 4B:
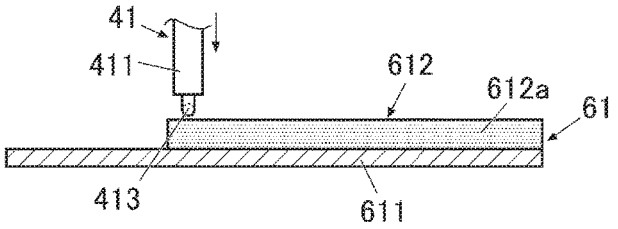
FIG. 4B is an explanatory diagram illustrating an appearance at the start of cleaning.
Figure 4C:
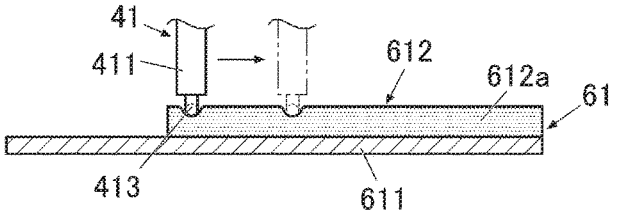
FIG. 4C is an explanatory diagram illustrating an appearance during a cleaning operation.
Figure 4D:
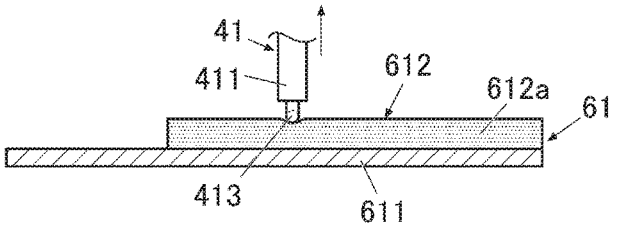
FIG. 4D is an explanatory diagram illustrating an appearance during the cleaning operation.
Figure 4E:
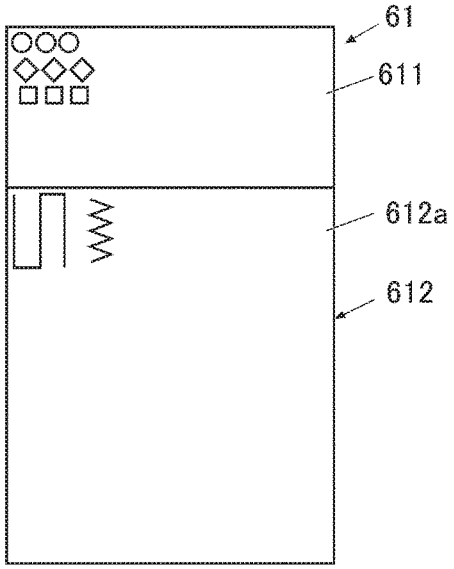
FIG. 4E is a top view illustrating an example of a maintenance part.
Figure 5:
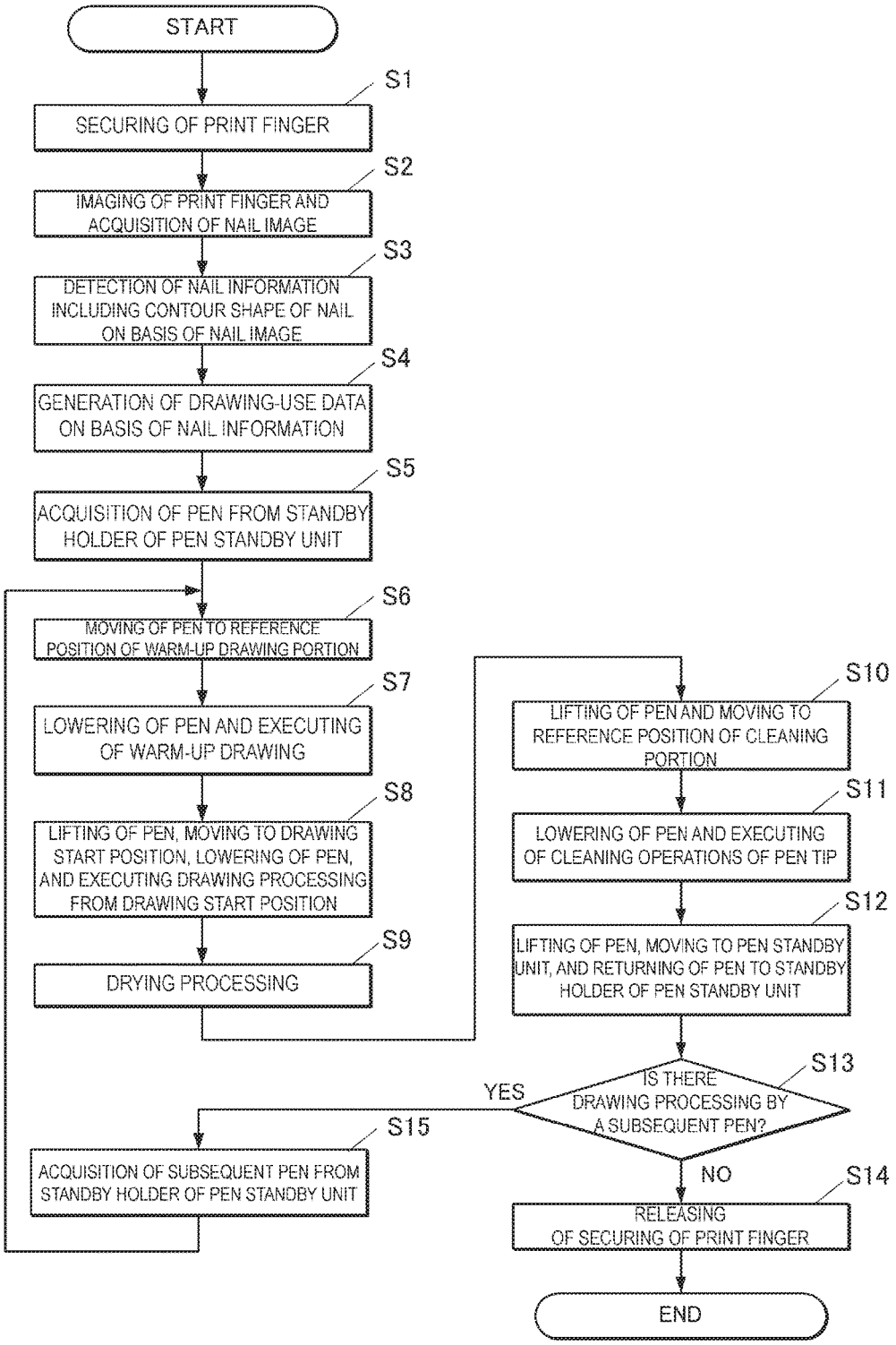
FIG. 5 is a flowchart illustrating drawing processing of the drawing apparatus according to the embodiment of the present invention.

For example, in the test drawing, small predetermined figures such as ○, ◇, and □ figures are drawn (see FIG. 4E). The figures drawn as the test drawing are not particularly limited, but it is preferable that the figures be drawable in a single stroke without having to lift and lower the pen, so that the drawing can be performed in a short period of time. It is also preferable that the figures be small and simple so that excessive ink is not wasted.

In the test drawing, it is preferable that the drawing position of the figures within the area of the test drawing part 611 is slightly shifted each time the test drawing is performed.

As such, for example, any position in the empty space in the test drawing part 611 is set as a reference position and, when performing test drawing of the pen tip 413, drawing operations are begun from this reference position. Note that in order to completely use the test drawing part 611 and produce as little waste as possible, it is preferable that the reference position of the test drawing part 611 be set at a position close to the region already used for test drawing. Movement distance of the pen will be shortened and required time will be shortened by setting the reference position in this manner.

If the drawing is performed while shifting the position as described above, there will be no possibility of the mixing of ink or the like due to the ink drawn by a different pen 41 adhering to the pen tip 413 when performing test drawing. Additionally, in cases where confirming whether or not drawing is performed correctly by using the image capturing device 51 to image the figure or the like drawn in the test drawing, it will be possible to clearly differentiate between the figures drawn by the pen 41 in the current test drawing and the figures previously drawn as a result of the test drawing being performed while shifting the drawing position.

Additionally, the cleaning part 612 includes a cleaning pad 612*a* against which the pen tip 413 of the pen 41 is pressed to sink into the cleaning pad 612*a*, and is configured to clean the pen tip 413.

The cleaning pad 612*a* has thickness and softness such that the pen tip 413 can somewhat sink thereinto. The pen tip 413 is pressed against the cleaning pad 612*a* and, in this sunk state, the pen tip 413 is enveloped and covered by the cleaning pad 612*a*. The cleaning pad 612*a* is formed of a material capable of removing ink and/or various types of debris remaining on the pen tip 413 by adsorbing or catching the ink and/or various types of debris. Examples of the material include products in the form of wovens or nonwovens made from chemical fibers such as polyester or natural fibers such as cotton, paper, felt, sponges, or the like. Note that it is preferable that the fibers constituting the cleaning pad 612*a* are ultrafine fibers instead of thick fibers because it will be possible to remove fine residue with ultrafine fibers.

Additionally, the cleaning pad 612*a* may be formed in a sheet-like shape with a size that fits in the maintenance part 61 and have a configuration in which the entire cleaning pad 612*a* is replaced when completely used. Alternately the cleaning pad 612*a* may be formed in a roll-form by winding a sheet-like member, and have a configuration in which a used portion is detached after the cleaning of the pen tip 413 and an unused portion is disposed in the cleaning part 612.

When performing drawing on the nail T, aggregates of the ink component of the pen 41, shavings present in uneven portions of the nail T or the base layer coating already applied to the nail T, sebum or other debris on the nail T, and the like adhere to the pen tip 413. Additionally, in cases where a pattern or the like is drawn by the ink jet head 71 between a first drawing by the pen 41 and a subsequent drawing by the next pen 41, a multi-color coating drawn on the nail T by the ink jet head 71 may also become adhered to the pen tip 413.

For the performance of the cleaning of the pen tip 413, the pen tip 413 is pressed against the surface of the cleaning pad 612*a* and, while the pen tip 413 is sunk into the cleaning pad 612*a* or, in other words, while the pen tip 413 is enveloped and covered by the cleaning pad 612*a*, the pen 41 is moved in the horizontal direction. As a result, the debris adhered to the pen tip 413 can be wiped off and removed by the cleaning pad 612*a*.

Note that in order to wipe the entire circumference of the pen tip 413, it is preferable that the pen 41 be moved while being made to meander on the horizontal plane as illustrated in FIG. 4E in order to clean the pen tip 413, rather than simply being moved linear in a single horizontal direction. Additionally, the pen tip 413 may be moved so as to draw a figure such as ○ for the cleaning, but it is preferable that the pen tip 413 be moved to a greater degree than in the test drawing.

Moreover, when cleaning the pen tip 413, it is preferable that the pen tip 413 also be lifted and lowered in the vertical direction in addition to being moved in the horizontal direction. That is, the pen tip 413 may be moved in the horizontal direction while also repeating vertical motion between states of the pen tip 413 being sunk into and in contact with the surface of the cleaning pad 612*a*.

Note that a configuration is possible in which the cleaning area of the cleaning pad 612*a* is subdivided and set, a different cleaning area is allocated to each of the pens 41, and the cleaning of the pen tips 413 is performed within these areas.

In this case, for example, any position in the empty space in the cleaning pad 612*a* is set as a reference position and, when performing cleaning of the pen tip 413, cleaning operations are begun from this reference position. Note that in order to completely use the cleaning pad 612*a* and produce as little waste as possible, it is preferable that the reference position of the cleaning pad 612*a* be set at a position close to the region already used for cleaning the pen tip 413.

With such a configuration, the pen tip 413 will not be cleaned in a cleaning area that was used to clean a pen tip 413 with a different ink adhered thereto, and re-adhesion of ink and/or debris to the pen tip 413 can be prevented.

Additionally, the cleaning pad 612*a* may be impregnated with a cleaning agent (solvent) for cleaning the pen tip 413.

The type of cleaning agent used in this case is not particularly limited. The cleaning agent impregnated in the cleaning pad 612*a* may be changed in accordance with, for example, the type of ink that may become adhered to the pen tip 413.

For example, a configuration is possible in which a cleaning-use pen, a syringe, or the like (not illustrated), in which a cleaning agent is stored in a storage portion, is provided near the cleaning pad 612*a* and, depending on the type of ink or the like that may become adhered to the target of the cleaning, namely the pen tip 413, a corresponding cleaning agent may be appropriately dripped from the cleaning-use pen or syringe so as to be supplied to and impregnated in the cleaning pad 612*a*.

Additionally, a configuration is possible in which cleaning positions in the cleaning pad 612*a* for each of the pens 41 are determined, and a cleaning agent, which corresponds to the type of ink or the like that may be adhered to the pen tip 413 of each of the pens 41, is impregnated at each of these cleaning positions.

Additionally, an ink jet maintenance portion 65 is provided on the top surface of the lower frame 11 across the finger receiving portion 31 on the side opposite the maintenance part 61, the pen standby unit 62, and the like (the right side in FIGS. 1A and 2 in the present embodiment). The ink jet maintenance portion 65 is configured from, for example, a cleaning mechanism for cleaning an ink discharging portion (nozzle surface) of the ink jet head 71 (described hereinafter), a cap mechanism for maintaining moist conditions of the ink discharging portion (nozzle surface), and the like (all not illustrated).

Additionally, a dryer 90 is provided on the rear side upper portion of the finger receiving portion 31 that is separated by the partition 31*c*. The dryer 90 is provided with a heater 91 for generating heat and a fan 92 for blowing air and has functions that direct the wind generated by the fan 92 through the window 31*e* to the nail T of the print finger U1 placed in the finger receiving portion 31, and dry an ink jet drawing performed by the ink jet drawing head 71 or a plotter drawing performed by the pen 41 on the nail T.

Note that it is preferable that the dryer 90 has a configuration in which the heater 91 can be switched ON and OFF depending on the application, and the fan 92 can be rotated while the heater 91 is OFF.

The drawing device 40 is configured from and provided with the drawing head 43, a unit supporting member 44 that supports the drawing head 43, the X-direction movement stage 45 for moving the drawing head 43 in the X direction (the X direction in FIG. 1A; the left-right direction of the drawing apparatus 1), an X-direction movement motor 46, the Y-direction movement stage 47 for moving the drawing head 43 in the Y direction (the Y direction in FIG. 1B; the front-back direction of the drawing apparatus 1), a Y-direction movement motor 48, and the like.

As illustrated in FIGS. 1A and 1B, in the drawing head 43 of the present embodiment, a pen holding portion 42 detachably holding the pen 41 and an ink jet holder 72 holding the ink jet head 71 are disposed adjacently to each other.

The ink jet head 71 is, for example, an ink cartridge-integrated head in which ink cartridges (not illustrated) corresponding to yellow (Y), magenta (M), and cyan (C) ink are formed integrally with an ink discharging portion (not illustrated) provided on a surface (in the present embodiment, the bottom surface in FIG. 1A and the like) facing the drawing object (the nail T) in each of the ink cartridges. The ink discharging portion is provided with a nozzle array consisting of a plurality of nozzles for spraying each color of ink. The ink jet head 71 micronizes the ink and performs the drawing by spraying the ink from the ink discharging portion directly on the target drawing surface of the drawing object (the nail T). Note that the ink jet head 71 is not limited to those that discharge the three colors of ink described previously. Ink cartridges holding other ink and ink discharging portions may also be provided.

The pen 41 is a writing utensil that has the surface of the nail T as its drawing object surface, and performs a drawing on the nail T by the tip portion thereof being brought into contact with the drawing object surface, namely the surface of the nail T.

As illustrated in FIG. 1A and the like, the pen 41 is provided with the pen tip 413 on a tip end side (the lower side in FIG. 1A) of a rod-like pen shaft portion 411 that is inserted through the interior of a hollow cylindrical pen holder 410.

An interior of the pen shaft portion 411 is an ink storing portion for storing various types of ink.

Any type of ink can be stored in the interior of the pen shaft portion 411.

Viscosity of ink, diameter of the coloring particles (particle size), and the like are not particularly limited and, for example, ink containing metallic glitter, white ink, UV-curable ink, ink for gel nails, ink for under coats (that is, white ink for base layer coating), ink for top coats, nail varnish, and the like can be used.

The pen 41 of the present embodiment has a configuration in which the pen tip 413 and the ink storing portion, namely the pen shaft portion 411, are integrally formed. The pen tip 413 is faced downward and brought into contact with the drawing object surface, namely the surface of the nail T, and the ink stored in the pen shaft portion 411 is transferred onto the drawing object surface, namely the surface of the nail T, by gravity and the interaction (that is, the viscous force) acting within the ink solution.

In the present embodiment, the pen 41 is a ballpoint pen in which the pen tip 413 draws by the ink stored in the pen shaft portion 411 being dispensed by pressing the pen tip 413 against the surface of the nail T.

Note that the pen 41 is not limited to a ballpoint pen. For example, the pen 41 may be a calligraphy-type (felt-tip) pen provided with a fiber block, porous resin or the like capable of being immersed in the ink in the pen shaft portion 411 and transferring the ink from the pen shaft portion 411 side to the pen tip 413; a brush pen that draws by soaking ink into a bundle of hairs; or the like. The pen 41 having the pen tip 413 of any desired thickness may be provided as well.

Note that, as described above, the pen 41 of the present embodiment has a configuration in which the pen tip 413 and the ink storing portion, namely the pen shaft portion 411 are integrally formed. As such, when immersed in a large volume of solvent (cleaning solution), the ink component is eluted from the pen tip 413 and the solvent component flows back into the ink storing portion, namely the pen shaft portion 411, due to the relationship between capillary action and osmotic pressure and, as a result, the concentration of the ink component declines.

On this point, as described in the present embodiment, the pen 41 is moved while the pen tip 413 is in a pressed state in which the pen tip 413 is pressed to sink into the cleaning pad 612*a*. As a result, aggregates of the ink component and/or other various types of debris can be rubbed off the entire circumference of the pen tip 413 without affecting the ink concentration and the like of the pen 41.

The pen holding portion 42 holds and fixes one of the pen 41 by a retaining portion (not illustrated), and is a member for moving the pen 41 together with the drawing head 43. In the present embodiment, the pen holding portion 42 is supported on a side portion of the drawing head 43.

Additionally, the pen holding portion 42 is configured to be movable in the vertical direction by the driving of a pen vertical motor 426 (see FIG. 3) that is mounted on the drawing head 43.

The unit supporting member 44 is fixed to the X-direction movement portion 451 that is attached to the X-direction movement stage 45. The X-direction movement portion 451 is configured to move on the X-direction movement stage 45 in the X direction along a guide (not illustrated) via the driving of the X-direction movement motor 46. Thus, the drawing head 43 that is attached to the unit supporting member 44 is configured to move in the X direction (the X direction in FIG. 1A and the left-right direction of the nail printing apparatus 1).

The X-direction movement stage 45 is fixed to a Y-direction movement portion 471 of the Y-direction movement stage 47. The Y-direction movement portion 471 is configured to move on the Y-direction movement stage 47 in the Y direction along a guide (not illustrated) via the driving of the Y-direction movement motor 48. Thus, the drawing head 43 that is attached to the unit supporting member 44 is configured to move in the Y direction (the Y direction in FIG. 1B and the front-back direction of the nail printing apparatus 1).

Note that in the present embodiment, the X-direction movement stage 45 and the Y-direction movement stage 47 are configured from combinations of the X-direction movement motor 46, the Y-direction movement motor 48, and ball screws and guides (not illustrated).

In the present embodiment, a head movement portion 49 is configured as an XY drive unit that drives the drawing head 43 provided with the pen 41 in the X direction and the Y direction via the X-direction movement motor 46, the Y-direction movement motor 48, and the like.

The pen vertical motor 426, the ink jet head 71, the X-direction movement motor 46, and the Y-direction movement motor 48 of the drawing device 40 are connected to a drawing control portion 814 of a control device 80 (see FIG. 3; described hereinafter), and are configured to be controlled by the drawing control portion 814.

The imaging unit 50 is provided with an image capturing device 51 and an illumination device 52.

The imaging unit 50 illuminates the nail T of the print finger U1, which is inserted into the finger receiving portion 31 and is visible through the opening of the upper portion, using the illumination device 52. Moreover, the print finger U1 is imaged by using the image capturing device 51 and, a captured image of the nail T of the print finger U1, namely a nail image (image of finger including nail image; see FIG. 4A) is acquired.

In the present embodiment, the image capturing device 51 and the illumination device 52 are fixed on a side (the right side of the drawing head 43 in FIG. 1A) of the drawing head 43 of the drawing device 40.

Specifically, as illustrated in FIGS. 1A and 1B, the drawing head 43 of the drawing device 40 has an overhanging portion 401 overhanging in a lateral direction from a first edge (the right side in FIG. 1A) of the top surface of the drawing head 43, and a substrate 53 is attached to the overhanging portion 401. The image capturing device 51 and the illumination device 52 constituting the imaging unit 50 are provided on a bottom surface of the substrate 53 so as to face the dividing wall 116.

Note that a size of the substrate 53 and positions where the image capturing device 51 and the illumination device 52 are attached to the substrate 53 are not particularly limited.

The image capturing device 51 is, for example, a small camera having a solid state image sensor with a pixel count of about 2 million pixels or greater, a lens, and the like.

In the present embodiment, a nail shape detection portion 812 (described hereinafter) detects the position of the nail T on the XY plane, the vertical position of the nail T, and other nail information, on the basis of the captured image (the nail image) acquired by the image capturing device 51.

Note that the image capturing device 51 is preferably configured to be moved by the head movement portion 49 so as to image the nail T from differing positions or angles and acquire a plurality of captured images (nail images) and, thereby, detect the curvature and the like of the nail T of the print finger U1.

In cases where the image capturing device 51 acquires a plurality of captured images (nail images), the nail shape detection portion 812 (see FIG. 3) can detect the curvature of the nail T on the basis of these captured images (nail images).

The illumination device 52 is, for example, a white LED or similar light source.

The illumination device 52 radiates light downward and illuminates at least an imaging area below the image capturing device 51. The position of the illumination device 52 with respect to the image capturing device 51 is fixed. Note that the disposal and number of the illumination devices 52 provided is not limited to the illustrated examples.

The imaging unit 50 is connected to an imaging control portion 811 of the control device 80 (described hereinafter, see FIG. 3), and is configured to be controlled by the imaging control portion 811.

Note that image data of the image imaged by the imaging unit 50 is stored in a nail image memory region 821 of a memory unit 82 (described hereinafter).

The control device 80 is, for example, arranged on a substrate 13 or the like disposed in the upper frame 12.

Figure 3:
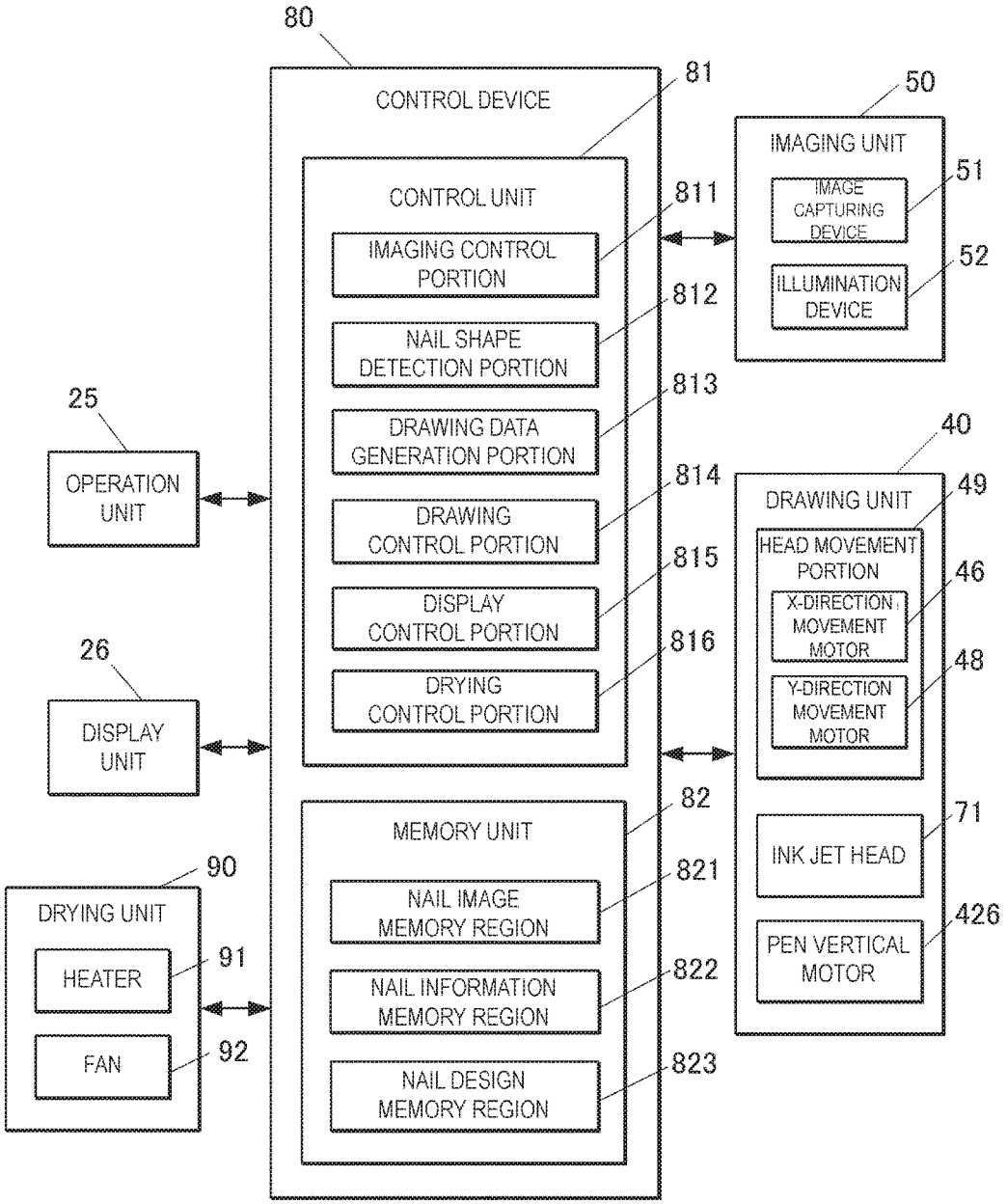
FIG. 3 is a main constituent block diagram illustrating a control configuration of the drawing apparatus according to the embodiment of the present invention.

FIG. 3 is a main constituent block diagram illustrating the control configuration according to the present embodiment.

As illustrated in FIG. 3, the control device 80 is a computer provided with a control unit 81 constituted by a central processing unit (CPU) (not illustrated), and the memory unit 82 constituted by a read only memory (ROM), a random access memory (RAM), or the like (neither illustrated).

Various programs to operate the nail printing apparatus 1, various data, and the like are stored in the memory unit 82.

Specifically, various programs are stored in the ROM of the memory unit 82 such as a nail information detection program for detecting various types of nail information such as the shape, the curvature in the width direction, the nail width, and the nail area of the nail T from the nail image (the captured image); a drawing data generation program for generating drawing data; and a drawing program for performing drawing processing. These programs are executed by the control device 80 and, thus, the components of the nail printing apparatus 1 are controlled in an integrated manner.

In the present embodiment, the memory unit 82 is provided with the nail image memory region 821 where the nail image (the captured image) of the nail T of the print finger U1 of a user acquired by the imaging unit 50 is stored, a nail information memory region 822 where the nail information detected by the nail shape detection portion 812 (the outline, curvature, and the like of the nail T, indicating the shape of the nail T) is stored, a nail design memory region 823 where image data of a nail design to be drawn on the nail T is stored, and the like.

When viewed from a function perspective, the control unit 81 is provided with the imaging control portion 811, the nail shape detection portion 812, a drawing data generation portion 813, the drawing control portion 814, a display control portion 815, a drying control portion 816, and the like. Functions of the imaging control portion 811, the nail shape detection portion 812, the drawing data generation portion 813, the drawing control portion 814, the display control portion 815, the drying control portion 816, and the like are realized by cooperation of the CPU of the control unit 81 and the programs stored in the ROM of the memory unit 82.

The imaging control portion 811 is configured to cause the image capturing device 51 to image finger images, that is, nail images (captured images) including images of the nail T of the print finger U1 inserted into the finger receiving portion 31, by controlling the image capturing device 51 and the illumination device 52 of the imaging unit 50.

In the present embodiment, while the imaging device 50 is moved by the drawing control portion 814 that controls the head movement portion 49, the imaging control portion 811 causes the image capturing apparatus 51 to image the nail T from a plurality of positions or angles in the width direction of the nail T (e.g. directly above the nail T and diagonally above the nail T, or the like), and acquire a plurality of the nail images (captured images).

Note that the number of captured images acquired for one nail T is not particularly limited, but it is preferable that two or more captured images be acquired from different positions in the width direction of the nail T because it will be possible to perform accurate detection, including the detection of the curvature of the nail T.

The image data of the finger images acquired by the imaging unit 50 is stored in the nail image memory region 821 of the memory unit 82.

The nail shape detection portion 812 is configured to detect the nail information on the nail T of the print finger U1 on the basis of the images (captured images) of the nail T of the print finger U1 inserted into the finger receiving portion 31, the image being imaged by the image capturing device 51.

In the present embodiment, the nail shape detection portion 812 detects the contour shape of the nail T as the nail information, on the basis of the captured images (nail images).

Note that the nail information acquired by the nail shape detection portion 812 is not limited to the contour shape of the nail T. For example, the nail information may include the X-Y coordinates of the horizontal position of the nail T, the height of the nail T (position in the vertical direction of the nail T, hereinafter referred to as the "vertical position of the nail T" or simply the "position of the nail T"), the shape in the width direction of the nail T, that is, the inclination angle with respect to the X-Y plane of the surface of the nail T (the curvature of the nail T or the inclination angle of the nail T), and the like.

The nail information acquired by the nail shape detection portion 812 is stored in the nail information memory region 822 of the memory unit 82.

The drawing data generation portion 813 generates drawing data (drawing-use data) for the drawing to be performed by the drawing head 43 on the nail T of the print finger U1, on the basis of the nail information detected by the nail shape detection portion 812.

Specifically, on the basis of the shape of the nail T (the contour shape) and the like detected by the nail shape detection portion 812, the drawing data generation portion 813 performs calibration processing, such as enlarging, reducing, and cropping, for calibrating the image data of the nail design to the shape of the nail T.

Additionally, the drawing data generation portion 813 functions as an image data correction portion that performs appropriate curvature correction on the image data of the nail design specified to be drawn on the nail T, in accordance with the curvature of the nail T detected by the nail shape detection portion 812.

As a result, drawing data for the nail design to be drawn by the pen 41 or the ink jet head 71 is generated.

The drawing control portion 814 is a control portion that outputs control signals to the drawing device 40 on the basis of the drawing-use data generated by the drawing data generation portion 813, and controls the operations of the X-direction movement motor 46, the Y-direction movement motor 48, the pen vertical motor 426, the ink jet head 71, and the like of the drawing device 40, so as to perform a drawing on the nail T that corresponds with the drawing-use data.

Additionally, in the present embodiment, the drawing control portion 814 is configured to cause the pen 41 to move to the test drawing part 611 and perform test drawing of the pen 41, prior to beginning drawing operations by the pen 41.

Specifically, first, the drawing control portion 814 causes the X-direction movement motor 46 and the Y-direction movement motor 48 to operate and move the pen 41 to the test drawing part 611, and then lower the pen 41 to a position where the pen tip 413 is in contact with the surface of the piece of paper or the like of the test drawing part 611. Then, as illustrated in FIG. 4A, the drawing control portion 814 appropriately causes the pen 41 to move above the test drawing part 611, and draw the ○, ◇, □ or similar figures as illustrated in FIG. 4E, thus preparing the state of the pen tip 413.

Furthermore, in the present embodiment, as an operation control unit for controlling the operations of the pen 41, the drawing control portion 814 causes the pen 41 to move to the cleaning part 612 and the cleaning of the pen tip 413 to be performed, after the drawing operation by the pen 41 is completed.

Specifically, first, the drawing control portion 814 causes the X-direction movement motor 46 and the Y-direction movement motor 48 to operate and move the pen 41 to the cleaning part 612. Then, as illustrated in FIG. 4B, the pen is lowered on the cleaning part 612 and, as illustrated in FIG. 4C, the pen tip 413 is pressed against the cleaning pad 612*a* to sink into the cleaning pad 612*a*. While maintaining this pressed state, the drawing control portion 814 causes the pen 41 to move appropriately. At this time, the pen 41 is caused to move back and forth and to meander, thereby drawing the lines, figures, or the like illustrated in FIG. 4E. As a result, aggregates of the ink and/or other various types of debris are wiped off of the entire circumference of the pen tip 413 by the cleaning pad 612*a*.

The display control portion 815 is configured to control the display unit 26 and cause the display unit 26 to display various types of display screens. In the present embodiment, examples of the various types of display screens the display control portion 815 is configured to display on the display unit 26 include nail design selection screens and thumbnail images for confirming designs, nail images acquired by imaging the print finger U1, various command screens, operation screens, and the like.

Additionally, the display control portion 815 may be configured to notify a user and display a message or the like on the display unit 26 prompting a user to replace the maintenance part 61 with a new maintenance part 61 in a case where no empty space remains in the test drawing part 611 or the cleaning part 612 of the maintenance part 61.

The drying control portion 816 is configured to control the drying operations of the dryer 90. The drying control portion 816 causes a drying process to be performed by the dryer 90 for the nail T that is inserted into the finger receiving portion 31 and on which the drawing has been performed.

Specifically, the drying control portion 816 appropriately switches the heater 91 and the fan 92 of the dryer 90 ON and OFF. Additionally, the drying control portion 816 is configured to appropriately perform temperature control of the heater 91 and, as necessary, is capable of turning the heater 91 OFF and only causing the fan 92 to operate.

Next, a drawing method by the nail printing apparatus (drawing apparatus) according to the present embodiment is described while referencing FIGS. 4A to 4E and FIG. 5.

In cases where performing drawing by using the nail printing apparatus 1, a user first operates a power switch to turn on the control device 80.

The display control portion 815 causes a design selection screen to be displayed on the display unit 26, and the user operates operation buttons or the like on the operation unit 25 and selects a desired nail design from among a plurality of nail designs displayed on the design selection screen. As a result, a selection command signal is output from the operation unit 25 and the nail design intended to be drawn on the nail T is selected.

Next, the user inserts the print finger U1 into the finger receiving portion 31, inserts the non-print fingers U2 into the finger clearing portion 32, and operates a drawing switch (not illustrated) of the operation unit 25, thereby holding the print finger U1 within the finger receiving portion 31 (step S1).

Upon input of a command from the draw switch and before starting the drawing operations, first, the drawing control portion 814 controls the head movement portion 49 and causes the imaging unit 50 to move to a predetermined imaging position, image the print finger U1, and acquire nail images (captured images) (step S2).

Upon acquisition of the nail images (the captured images), the nail shape detection portion 812 detects the outer shape, namely the contour shape, of the nail T on the basis of the nail images (the captured images). Additionally, the nail shape detection portion 812 detects the curvature of the nail T and other nail information on the basis of the nail images (the captured images) (step S3).

Next, the drawing data generation portion 813 generates drawing-use data (drawing data of a nail design) for drawing a nail design selected by the user on the nail T of the user, on the basis of the nail information detected by the nail shape detection portion 812 (step S4).

Upon generation of the drawing-use data, the drawing control portion 814 acquires the pen 41 (e.g. first, in order to apply a base layer, a pen 41 that draws base layer white ink) required to draw the nail design from the standby holders 63 of the pen standby unit 62 (step S5).

Then, the drawing control portion 814 causes the head movement portion 49 to operate so as to move the drawing head 43 and move the pen 41 to the reference position of the test drawing part 611 (step S6).

The drawing control portion 814 causes the pen vertical motor 426 to operate at the reference position so as to lower the pen 41 to a position where the pen tip 413 is in contact with the surface of the test drawing part 611, and causes the drawing head 43 to appropriately move and draw a predetermined figure or the like, thereby causing the test drawing of the pen 41 to be performed (step S7; see FIG. 4A).

Upon completion of the test drawing of the pen 41, the drawing control portion 814 causes the pen vertical motor 426 to operate and lift the pen 41 to a position where not in contact with the surface of the test drawing part 611; causes the head movement portion 49 to operate and move the drawing head 43 to a drawing start position (e.g. the upper edge of the right edge of the nail T, or the like) above the nail T; causes the pen vertical motor 426 to operate and lower the pen 41 to a position where the pen tip 413 is in contact with the surface of the nail T at the drawing start position; causes the drawing head 43 to appropriately move; and causes the drawing processing by the pen 41 to be executed (step S8).

Upon completion of the drawing processing by the pen 41, the drying control portion 816 controls the dryer 90 and drying operation of the nail T on which the ink has been applied is performed (step S9).

As an operation control unit for controlling the operations of the pen 41, the drawing control portion 814 causes the pen vertical motor 426 to operate and lift the pen 41 to a position not in contact with the surface of the nail T, and causes the head movement portion 49 to operate and move the drawing head 43 to the reference position, which is a position above the cleaning pad 612*a* of the cleaning part 612, where the cleaning is to be begun (step S10; see FIG. 4B).

Then, at the reference position, the drawing control portion 814 causes the pen vertical motor 426 to operate and lower the pen 41, press the pen tip 413 against the cleaning pad 612*a* such that the pen tip 413 sinks into the cleaning pad 612*a* and, while maintaining this pressed state, appropriately move the pen 41 and perform the cleaning operation of the pen tip 413 (step S11; see FIG. 4C).

Upon completion of the predetermined cleaning operation, the drawing control portion 814 causes the pen vertical motor 426 to operate and lift the pen 41 (see FIG. 4D), and arrange the pen tip 413 in a state where not in contact with the surface of the cleaning pad 612*a*; and causes the head movement portion 49 to operate and move the drawing head 43 to the pen standby unit 62 and return the pen 41 to an empty standby holder 63 (step S12).

The control unit 81 determines whether or not there is drawing processing by a subsequent pen 41 (e.g. drawing of a line on the base layer by using an ink containing glitter, or the like) (step S13). In cases where there is no drawing processing by a subsequent pen 41 (step S13; NO), the holding of the print finger U1 inserted into the finger receiving portion 31 is released (step S14), and the drawing processing is terminated.

On the other hand, in cases where there is drawing processing by a subsequent pen 41 (step 13; YES), the drawing control portion 814 acquires the pen 41 that will perform the subsequent drawing processing (e.g. a pen 41 that draws by using ink containing glitter for drawing a line containing glitter) from the standby holders 63 of the pen standby unit 62 (step S15). Then, the processing is repeated from step S6.

While not illustrated in the drawings, in cases where there is no drawing processing by another pen 41 (step S13; NO) but there is drawing processing by the ink jet head 71, drawing processing by the ink jet head 71 and drying processing by the dryer 90 are caused to be performed after step S13 but before the releasing of the holding of the print finger (step S14).

As described above, according to the present embodiment, the cleaning pad 612*a* against which the pen tip 413 of the pen 41 is pressed to sink into the cleaning pad 612*a* is provided, and also a cleaning part 612 for cleaning the pen tip 413, a drawing device 40 provided with at least one pen 41 for performing drawing on a nail T by being brought into contact with the surface of the nail T, and the drawing control portion 814 that serves as an operation control unit for controlling the operations of the pen 41 are provided. At a time of cleaning the pen 41, the drawing control portion 814 is configured to cause the pen tip 413 to be pressed against the cleaning pad 612*a* and, while maintaining this pressed state, move the pen 41.

As a result, even in cases where the ink component is eluted from the pen tip 413, the solvent component flows back into the ink storing portion, namely the pen shaft portion 411, and the concentration of the ink component decreases due to the pen tip 413 and the ink storing portion, namely the pen shaft portion 411 being integrated and due to the relationship of capillary action and osmotic pressure when the pen tip 413 is immersed in the cleaning agent, the cleaning pad 612*a* wipes off or catches aggregates of the ink component and/or other various types of debris on the entire circumference of the pen tip 413. Thus, the aggregates of the ink component and/or other various types of debris can be easily and reliably removed without affecting the concentration of the ink of the pen 41 or the like.

Additionally, in cases where the cleaning pad 612*a* is impregnated with a cleaning agent for cleaning the pen tip 413, even in a case where debris such as aggregates of the ink component or the like is caked on the pen tip 413, this debris can be wiped away while melting the debris with a cleaning agent that contains various types of solvents and the like. As such, debris such as aggregates of the ink component or the like adhered to the pen tip 413 can be more reliably removed.

Additionally, in the present embodiment, cleaning of the pen tip 413 at the cleaning part 612 is performed after the drawing but before returning the pen 41 to the pen standby unit 62. The aggregates of the ink component and/or other various types of debris adhered to the pen tip 413 dry over time and harden, becoming difficult to remove. However, by performing cleaning of the pen tip 413 before returning the pen 41 to the pen standby unit 62 as in the present embodiment, the debris can be easily removed, and the next time the pen 41 is used, drawing operations can be performed free of adhered debris.

The embodiment described above is for the purpose of elucidating the present invention and is not to be construed as limiting the present invention. The invention can of course be altered and improved without departing from the gist thereof.

For example, in the present embodiment, an example of a case has been described in which the cleaning processing of the pen tip 413 is performed only after the ending of the drawing operations by the pen 41. However, the timing at which the cleaning processing of the pen tip 413 is performed is not limited thereto.

For example, the test drawing part 611 for performing test drawing of the pen 41 is provided and, in cases where it is determined on the basis of the results of the test drawing in the test drawing part 611 that the pen 41 is not in a drawable condition, the operation control unit, namely the drawing control portion 814 may be configured to control the operations of the pen 41 and performed cleaning of the pen tip 413 at the cleaning part 612.

In this case, specifically, the appearance of the test drawing at the test drawing part 611 is imaged by the image capturing device 51 of the imaging unit 50, the captured image is analyzed, and the control unit 81 determines whether or not the figures for the test drawing have been correctly drawn. Then, in cases where it is determined that the figures have not been correctly drawn, the drawing control portion 814 causes the pen 14 to move to the cleaning part 612, press into the cleaning pad 612*a* and, while maintaining this pressed state, causes the pen 41 to move.

As a result, cleaning processing of the pen tip 413 is performed in which aggregates of the ink component and/or other various types of debris are removed from the entire circumference of the pen tip 413 by the cleaning pad 612*a*.

With such a configuration, the state of the pen 41 can be confirmed before drawing on the nail T because it is determined whether or not the figures for the test drawing are correctly drawn. Therefore, drawing on the nail T can be appropriately performed.

Additionally, in cases where the cause for incorrect drawing in the test drawing is debris and/or clogging of the pen tip 413, cleaning of the pen tip 413 by the cleaning part 612 can be performed before drawing and, as a result, the pen tip 413 may become capable of drawing. Thus, by provisionally performing the cleaning processing by the cleaning part 612, waste created by simply replacing and disposing of the current pen 41 with a pen 41 capable of drawing can be avoided.

Note that in cases where the cleaning processing has been performed, test drawing may be performed again at the test drawing part 611. By doing this, the drawing on the nail T can be performed with a pen 41 that is certainly in a state suitable for drawing.

Furthermore, the cleaning processing of the pen tip 413 may be performed at timings during drawing when the ink fades, or when drawing cannot be performed. In this case as well, in cases where the cause for incorrect drawing is debris and/or clogging of the pen tip 413, cleaning of the pen tip 413 is performed and, as a result, the pen tip 413 may be become capable of drawing and there is a possibility that cancellation and the like of the drawing can be avoided.

Additionally, in the present embodiment, an example of a case has been described in which the cleaning processing of the pen tip 413 of the pen 41 is performed. However, object to be cleaned is not limited thereto.

For example, cleaning of the ink discharging portion (nozzle surface) of the ink jet head 71 may be performed. As with the cleaning of the pen tip, the nozzle tips of the ink jet head 71 are cleaned by pressing the nozzle tips into the cleaning pad 612*a*. The pen vertical motor 426 may be used for this cleaning as well, a dedicated ink jet vertical motor may be provided, or a configuration in which no motor for lifting and lowering the ink jet head is provided may be used in which the thickness of the cleaning pad 612*a* is set to a height at which the ink jet head can be pressed thereagainst. In this case, the ink jet maintenance portion 65 does not need to be a cleaning mechanism for cleaning the ink discharging portion (nozzle surface), and may have a configuration in which only the cap mechanism for maintaining moist conditions of the ink discharging portion (nozzle surface) is provided. Thus, simplification of the mechanism is possible.

Additionally, in the present embodiment, an example of a case has been described in which the test drawing of the pen 41 is performed at the test drawing part 611, but the operations performed at the test drawing part 611 are not limited thereto.

For example, in cases such as that described above where cleaning of the ink discharging portion (nozzle surface) of the ink jet head 71 is performed at the cleaning part 612, discharge of ink from the nozzles may also be performed at the test drawing part 611. Examining the state of the discharged ink in order to determine whether or not to perform cleaning and the like is the same as for the pen 41.

Additionally, in the present embodiment, an example of a case has been described in which all of the operations and actions are performed by the single nail printing apparatus 1.

However, the configuration by which the nail printing apparatus 1 is operated is not limited thereto.

Figure 6:
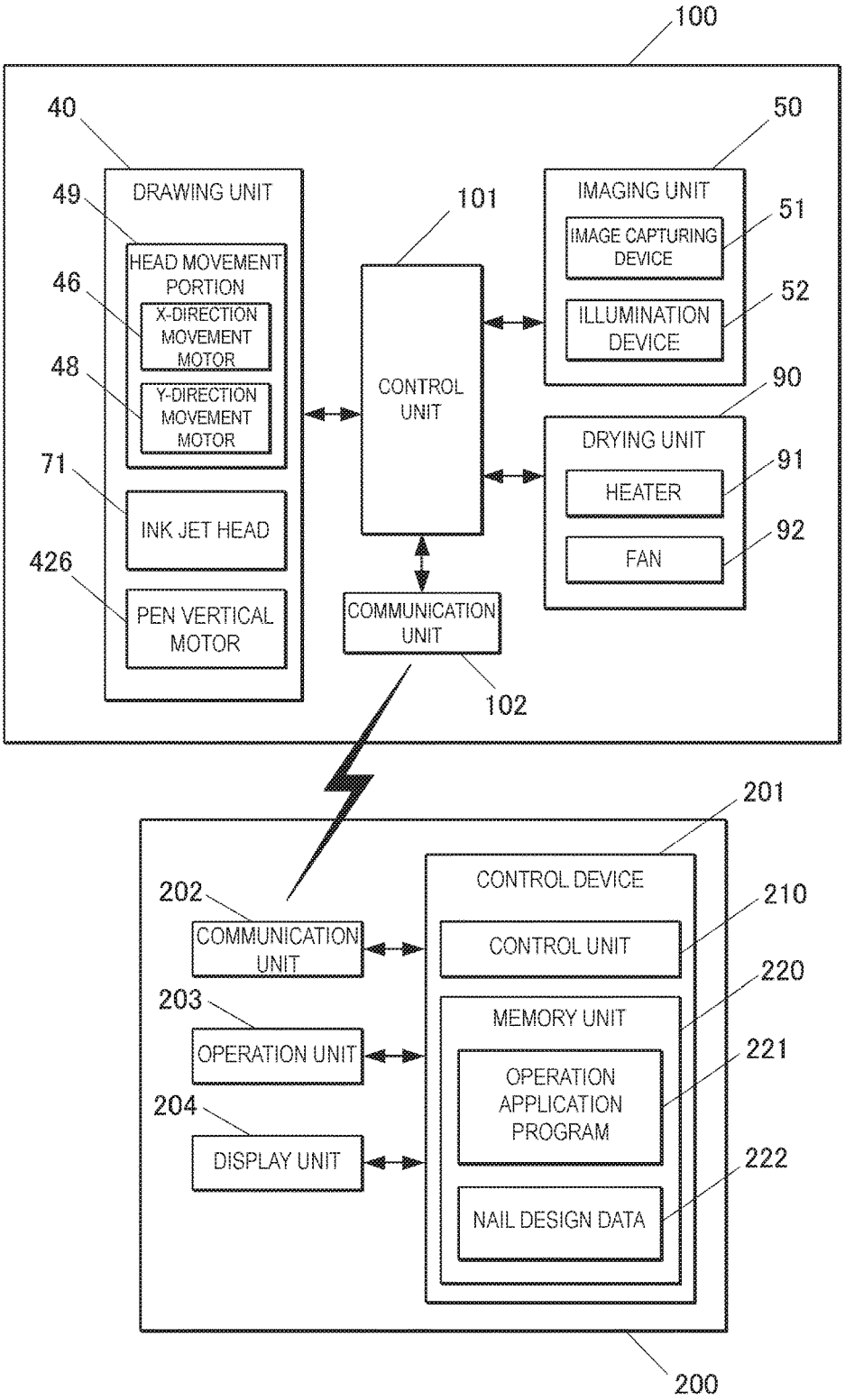
FIG. 6 is a main constituent block diagram illustrating a control configuration of the drawing apparatus according to the modified example of the embodiment of the present invention.

For example, as illustrated in FIG. 6, a configuration is possible in which a drawing apparatus (drawing apparatus unit) is provided that includes a nail printing apparatus main body 100 that is provided with the drawing device 40, the imaging unit 50, and the dryer 90 as in the present embodiment, a control unit (processor) 101 for operating these components, and a communication unit 102 capable of communication with an external device; and an operating terminal device 200 that communicates with the nail printing apparatus main body 100, for performing various types of processing, operations/commands, and the like.

In this case, the operating terminal device 200 is provided with a control device 201 that includes a control unit (processor) 210 for performing image processing and the like and a memory unit 220 in which an operation application program 221, nail design data 222, and the like are stored; a communication unit 202 for performing communication between the nail printing apparatus main body 100 or the like and the external device; an operation unit 203 where a user can perform input operations for various operations/commands; and a display unit 204 capable of displaying various images, command screens, and the like.

In cases where this configuration is adopted, images and the like imaged by the imaging unit 50 are sent from the nail printing apparatus main body 100 to the operating terminal device 200 via the communication units 102 and 202. Additionally, the detection of nail information is performed in the control unit 201 of the operating terminal device 200. Furthermore, the control unit 101 of the nail printing apparatus main body 100 controls the drawing device 40, the dryer 90, and the like on the basis of these results and, thus, causes the drawing operations and the cleaning operations to be performed.

Note that, in this case, the nail design data is not limited to being stored in the memory unit 220 in the operating terminal device 200, and a configuration is possible in which the nail design data can be acquired from an external storage device via various types of communication networks.

Additionally, in the present embodiment, a configuration has been described in which the drawing head 43 of the nail printing apparatus (the drawing apparatus) 1 is provided with the pen holding portion 42 that holds the pen 41 for drawing and also the ink jet head 71. However, the drawing apparatus need not have a configuration in which both the pen 41 and the ink jet head 71 are provided and may have a configuration in which drawing is performed by only the pen 41 or a configuration in which drawing is performed by only the ink jet head 71.

Additionally, in the present embodiment, an example of a case is described in which the drawing head 43 is provided with one pen holding portion 42, but the number of pen holding portions 42 provided in the drawing head 43 is not limited to one. For example, a configuration is possible in which two or more pen holding portions 42 are provided and two or more pens 41 for drawing are held.

Additionally, in the present embodiment, an example of a case is described in which the image capturing apparatus 51 and the illumination device 52 are mounted to the drawing head 43, but the positions at which the image capturing apparatus 51 and the illumination device 52 are provided are not limited thereto.

For example, a mechanism for moving the imaging unit 50 may be provided separately from the mechanism for moving the drawing head 43.

Additionally, for example, the image capturing device 51 and the illumination device 52 may be fixedly disposed to a ceiling portion or the like of the nail printing apparatus 1. In this case, it is preferable that two or more of the image capturing apparatus 51 be provided at offset positions in order to capture two or more nail images from different positions/angles for detecting the shape, curvature, and the like of the nail T as the nail information.

Additionally, in the embodiments described above, an example of the nail printing apparatus 1 in which one finger at a time is inserted and successive drawing is performed. However, a configuration is possible in which drawing is performed consecutively on a plurality of fingers without inserting and removing each finger.

The embodiment described above is not to be construed as limiting the scope of the present invention and include the scope of the invention recited in the claims and equivalents.

The present invention has been described using specific embodiments, but it goes without saying that the technical scope of the present invention is not limited to these embodiments. The embodiments described above are not to be construed as limiting the scope of the present invention and include the scope of the invention recited in the claims and equivalents.

It is obvious to a person skilled in the art that various modifications and improvements can be made to the specific embodiments described above, and it is obvious from the recitations of the claims that aspects including such modification and improvements are encompassed within the technical scope of the present invention.

The invention claimed is:

1. A drawing apparatus comprising:

a drawing device comprising at least one pen or nozzle configured to perform a drawing on a nail;

a processor configured to control operations of the pen or the nozzle; and a maintenance part comprising a cleaning pad provided to clean a tip of the pen or the nozzle and a test drawing part configured to perform test drawing or discharging of the pen or the nozzle;

wherein the processor causes the tip of the pen or the nozzle to be cleaned by bringing the tip of the pen or the nozzle into a contact state in which the tip of the pen or the nozzle contacts the cleaning pad, and wherein the processor performs control to notify a user to replace the maintenance part in a case in which at least one of the cleaning pad and the test drawing part has no empty space.

2. The drawing apparatus according to claim 1, wherein:

the processor causes the tip of the pen or the nozzle to be cleaned by moving the pen or the nozzle while maintaining the contact state.

3. The drawing apparatus according to claim 1, wherein:

in a case in which a result of the test drawing or the discharging at the test drawing part indicates that the pen or the nozzle is not in a drawable state, the processor controls operations of the pen or the nozzle so as to perform cleaning of the tip of the pen or the nozzle at the cleaning pad.

4. The drawing apparatus according to claim 1, wherein:

the cleaning pad includes a material capable of removing debris adhered to the tip of the pen or the nozzle by adsorbing or catching the debris.

5. The drawing apparatus according to claim 1, wherein:

the cleaning pad is impregnated with a cleaning agent configured to clean the tip of the pen or the nozzle.

6. A drawing method for a drawing apparatus, wherein the drawing apparatus comprising: comprises (i) drawing device comprising at least one pen or nozzle configured to perform a drawing on a nail, and (ii) a maintenance part comprising a cleaning pad provided to clean a tip of the pen or the nozzle and a test drawing part configured to perform test drawing or discharging of the pen or the nozzle, the drawing method comprising:

causing the tip of the pen or the nozzle to be cleaned by bringing the tip of the pen or the nozzle into a contact state in which the tip of the pen or the nozzle contacts the cleaning pad; and notifying a user to replace of the maintenance part, in a case in which at least one of the cleaning pad and the test drawing part has no empty space.

7. The drawing method according to claim 6, wherein:

causing the tip of the pen or the nozzle to be cleaned comprises moving the pen or the nozzle while maintaining the contact state.

8. The drawing method according to claim 6, further comprising:

controlling operations of the pen or the nozzle to perform cleaning of the tip of the pen or the nozzle at the cleaning pad, in a case in which a result of the test drawing or the discharging at the test drawing part indicates that the pen or the nozzle is not in a drawable state.

9. The drawing method according to claim 6, wherein:

the cleaning pad includes a material capable of removing debris adhered to the tip of the pen or the nozzle by adsorbing or catching the debris.

10. The drawing method according to claim 6, wherein:

the cleaning pad is impregnated with a cleaning agent configured to clean the tip of the pen or the nozzle.

11. A non-transitory computer-readable recording medium on which a drawing control program for a drawing apparatus is stored, wherein the drawing apparatus comprises (i) a drawing device comprising at least one pen or nozzle configured to perform a drawing on a nail, (ii) maintenance part comprising a cleaning pad provided to clean a tip of the pen or the nozzle and a test drawing part configured to perform test drawing or discharging of the pen or the nozzle, and (iii) a computer configured to control operations of the pen or the nozzle, the drawing control program being executable by the computer to perform operations comprising:

causing the tip of the pen or the nozzle to be cleaned by bringing the tip of the pen or the nozzle into a contact state in which the tip of the pen or the nozzle contacts the cleaning pad at a time of cleaning the pen or the nozzle; and notifying a user to replace the maintenance part in a case in which at least one of the cleaning pad and the test drawing part has no empty space.

12. The non-transitory computer-readable recording medium according to claim 11, wherein:

causing the tip of the pen or the nozzle to be cleaned comprises moving the pen or the nozzle while maintaining the contact state.

13. The non-transitory computer-readable recording medium according to claim 11, the operations further comprising:

controlling operations of the pen or the nozzle to perform cleaning of the tip of the pen or the nozzle at the cleaning pad, in a case in which a result of the test drawing or the discharging at the test drawing part indicates that the pen or the nozzle is not in a drawable state.

14. The non-transitory computer-readable recording medium according to claim 11, wherein:

the cleaning pad includes a material capable of removing debris adhered to the tip of the pen or the nozzle by adsorbing or catching the debris.

15. The non-transitory computer-readable recording medium according to claim 11, wherein:

the cleaning pad is impregnated with a cleaning agent configured to clean the tip of the pen or the nozzle.

* * * * *